US006132182A

United States Patent [19]

Khan et al.

[11] Patent Number: 6,132,182

[45] Date of Patent: Oct. 17, 2000

[54] INTEGRATED MOTOR AND BLOWER APPARATUS

[75] Inventors: Khan Mohamed Khirullah Genghis Khan, Niskayuna; Roger Neal Johnson, Hagaman, both of N.Y.; Thomas Merlin Jahns, Boxborough, Mass.; Vijay Kumar Stokes, Niskayuna, N.Y.; John Leo August, Jr.; Harold Lown, both of Schenectady, N.Y.

[73] Assignee: General Electric Company, Schenectady, N.Y.

[21] Appl. No.: 09/224,163

[22] Filed: Dec. 31, 1998

Related U.S. Application Data

[62] Division of application No. 08/764,188, Dec. 13, 1996, Pat. No. 5,893,705.

[51] Int. Cl.[7] ..... F04B 17/00

[52] U.S. Cl. ..... 417/354; 417/423.7

[58] Field of Search ..... 417/354, 356, 417/423.7, 423.8, 423.15

[56] References Cited

U.S. PATENT DOCUMENTS

| | | | |
|---|---|---|---|
| 3,874,191 | 4/1975 | Hudson | 62/426 |
| 4,523,896 | 6/1985 | Lhenry et al. | 417/244 |
| 4,644,207 | 2/1987 | Catterfeld et al. | 417/423.7 |
| 4,672,819 | 6/1987 | Mino et al. | 62/298 |
| 4,963,076 | 10/1990 | Fleischmann et al. | 417/423.7 |
| 5,049,770 | 9/1991 | Gaeth et al. | 310/89 |
| 5,078,741 | 1/1992 | Bramm et al. | 417/356 |
| 5,470,208 | 11/1995 | Kletschka | 417/356 |
| 5,588,814 | 12/1996 | DeFilippis et al. | 417/423.7 |
| 5,591,017 | 1/1997 | Dwyer | 417/366 |
| 5,704,111 | 1/1998 | Johnson et al. | 29/598 |
| 5,710,474 | 1/1998 | Mulgrave | 310/254 |
| 5,893,705 | 4/1999 | Khan et al. | 417/354 |

*Primary Examiner*—Henry C. Yuen
*Assistant Examiner*—Mahmoud M Gimie
*Attorney, Agent, or Firm*—Ann M. Agosti; Jill M. Breedlove

[57] ABSTRACT

A blower unit which, in one embodiment, includes an elongate main mounting member, a stator, a fan subassembly, and a blower housing, is described. In the one embodiment, the elongate main mounting member is the main structural member of the unit. The stator includes a stator core and stator windings, and the stator is secured to the main mounting member. The fan subassembly includes a rotor and a plurality of vanes. The rotor includes a substantially cylindrical iron ring and a magnetic portion having a substantially cylindrical shape. The magnetic portion is secured within the inner diameter of the iron ring and defines a rotor bore. The stator is located in the rotor bore and is concentric with respect to the rotor. The rotor is coupled to the plurality of vanes so that the vanes rotate with the rotor. The fan subassembly also includes bearing assemblies which are spring biased toward, and into rotatable engagement with, the elongate main mounting member. The fan assembly further includes a shroud for partially enclosing the plurality of vanes.

12 Claims, 3 Drawing Sheets

FIG. 2
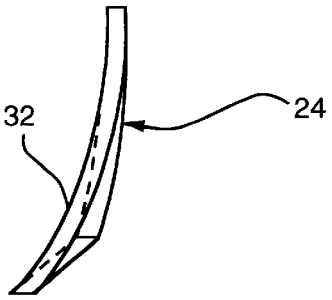
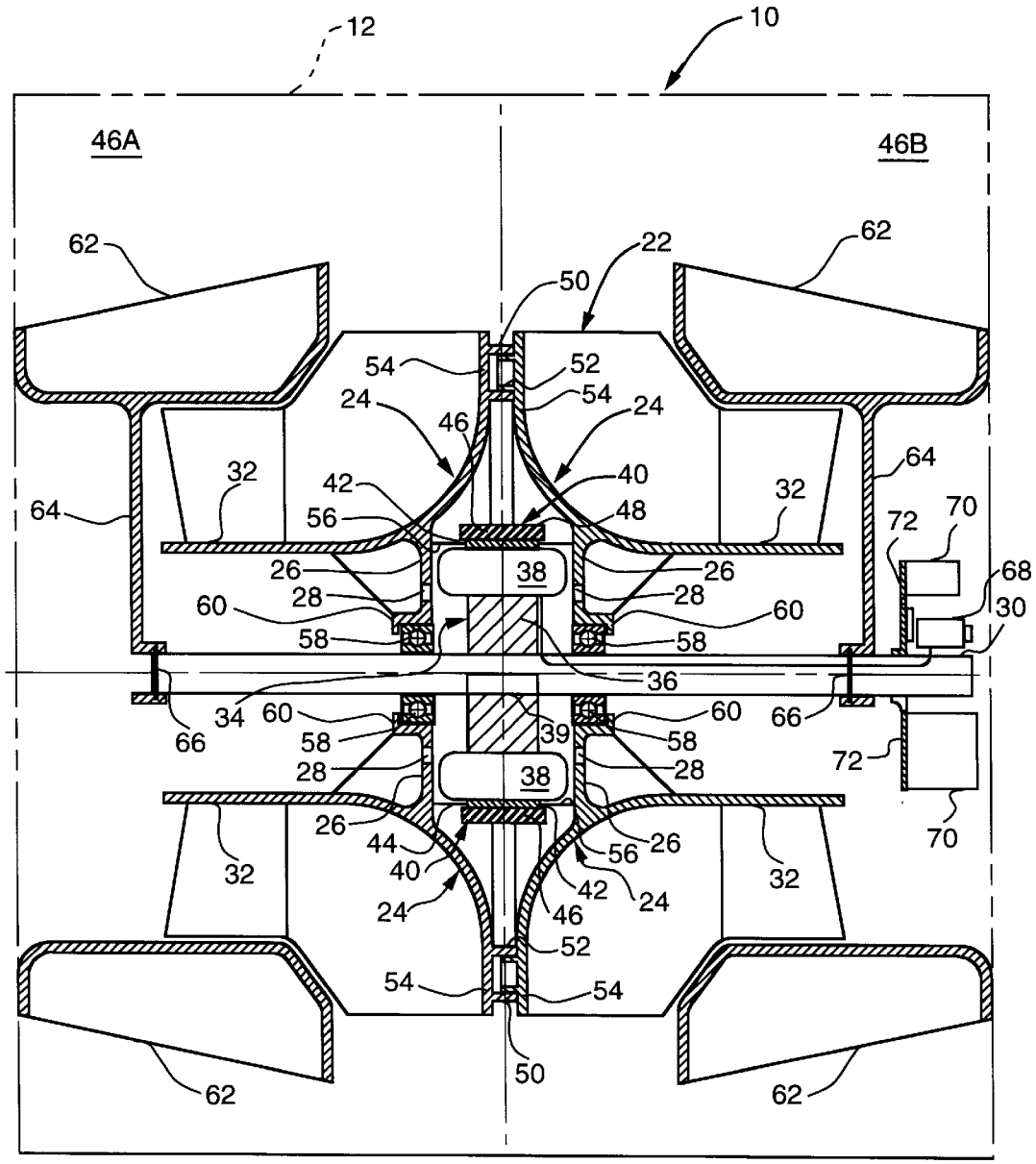
FIG. 3

INTEGRATED MOTOR AND BLOWER APPARATUS

This application is a division of application Ser. No. 08/764,188, filed Dec. 13, 1996 Pat. No. 5,893,705 which is hereby incorporated by reference in its entirety.

FIELD OF THE INVENTION

This invention relates generally to electric motors and, more particularly, to an integrated motor and blower configuration particularly suitable for heating, ventilation and air conditioning applications.

BACKGROUND OF THE INVENTION

A known blower unit used in heating, ventilation and air conditioning (HVAC) applications includes subcomponents such as an electric motor, a blower wheel (sometimes referred to in the art as a "squirrel-cage" fan), and a housing. The electric motor, in one well known configuration, includes a stator including a stator core and windings, and a rotor including a cylindrical shaped magnetic rotor core and a rotor shaft concentric with the rotor core. The rotor core is located in, and rotatable relative to, the stator bore. The rotor shaft is coupled at one end to the blower wheel. Each subcomponent, e.g., the motor, the blower wheel, and the housing, of the above described blower assembly is separately manufactured. The separately manufactured subcomponents are then assembled to form the blower unit.

In operation, the stator windings are energized and generate a rotating magnetic field. The rotating magnetic field generated by the stator windings couples with the magnetic field of the magnetic rotor core. The rotor begins to rotate when the magnetic fields couple, and the blower wheel rotates with the rotor shaft.

The blower unit cost typically is one of the highest cost components in an HVAC system. Therefore, any reduction in the cost of the blower unit may be significant with respect to economic feasibility of an HVAC system. Since the blower unit subcomponents are manufactured separately, in the past, blower unit costs typically have been reduced by reducing the cost of the separate subcomponents. Of course, reducing the cost of a subcomponent typically results in reducing the cost of the overall unit.

In addition to the blower unit cost, the efficiency of a blower unit also is important, particularly in an HVAC application. For example, in an HVAC system, the blower unit may operate for extended periods of time year round. The efficiency of the blower unit, therefore, is important to maintain energy consumption at a reasonable level.

It would be desirable to provide a lower cost, in terms of both material costs and labor costs, blower unit than known blower units. Such a lower cost blower unit, however, should not be any less efficient to operate than the known blower units.

SUMMARY OF THE INVENTION

These and other objects are attained by a blower unit which, in one embodiment, includes an integrated fan, rotor and shroud. The integrated components are sometimes referred to herein as a fan subassembly. The blower unit also includes an elongate main mounting member and a stator. In the one embodiment, the elongate main mounting member is the main structural support for the unit. The stator includes a stator core and stator windings. The stator core is secured to the main mounting member.

The fan subassembly includes a rotor and a plurality of vanes forming the fan. The rotor includes a substantially cylindrical iron ring and a magnetic portion having a substantially cylindrical shape. The rotor magnetic portion is secured to an inner surface of the iron ring and defines a rotor bore. The stator is located in the rotor bore and is concentric with respect to the rotor bore. The rotor is coupled to the plurality of vanes so that the vanes rotate with the rotor. The fan subassembly also includes bearing assemblies which are spring biased towards, and into rotatable engagement with, the elongate main mounting member. The bearing assemblies are secured to air baffle and bearing supports which extend from the vanes. The fan subassembly further includes a shroud for at least partially enclosing the plurality of vanes. The vanes and the shroud of the fan subassembly are molded from a plastic.

In one embodiment, and for ease of assembly, the fan subassembly includes first and second fan subassembly units. The first and second fan subassembly units each include a plurality of vanes. The vanes each include an axial flow inducer portion and a radial flow impeller portion. In another embodiment, the vanes of the fan subassembly each include only radial flow impeller portions.

The rotor is mounted in the first fan subassembly unit. The second fan subassembly unit includes a cutout portion for receiving a portion of the rotor when assembled to the first fan subassembly unit. In addition, the first fan subassembly unit includes first bosses and the second fan subassembly unit includes second bosses. The first bosses and the second bosses are configured to form an interference fit to securely maintain the first and second fan assembly units in engagement.

The fan subassembly described above is believed to greatly simplify both the manufacture and assembly of the blower unit. As a result, the above described blower unit is believed to be less expensive to manufacture and assemble than known blower units. In addition, by using an efficient motor such as an electronically commutated motor (ECM), the above described blower unit is believed to be more efficient than known blower units. Therefore, the above described blower unit is believed to be both lower in cost and more efficient than known blower units.

BRIEF DESCRIPTION OF THE DRAWINGS

FIG. 2 is an elevated perspective view of a portion of a vane used in the blower unit shown in FIG. 1.

FIG. 3 is a cross section, with parts cut-away, of the blower unit shown in FIG. 1.

DETAILED DESCRIPTION OF THE DRAWINGS

Figure 1:
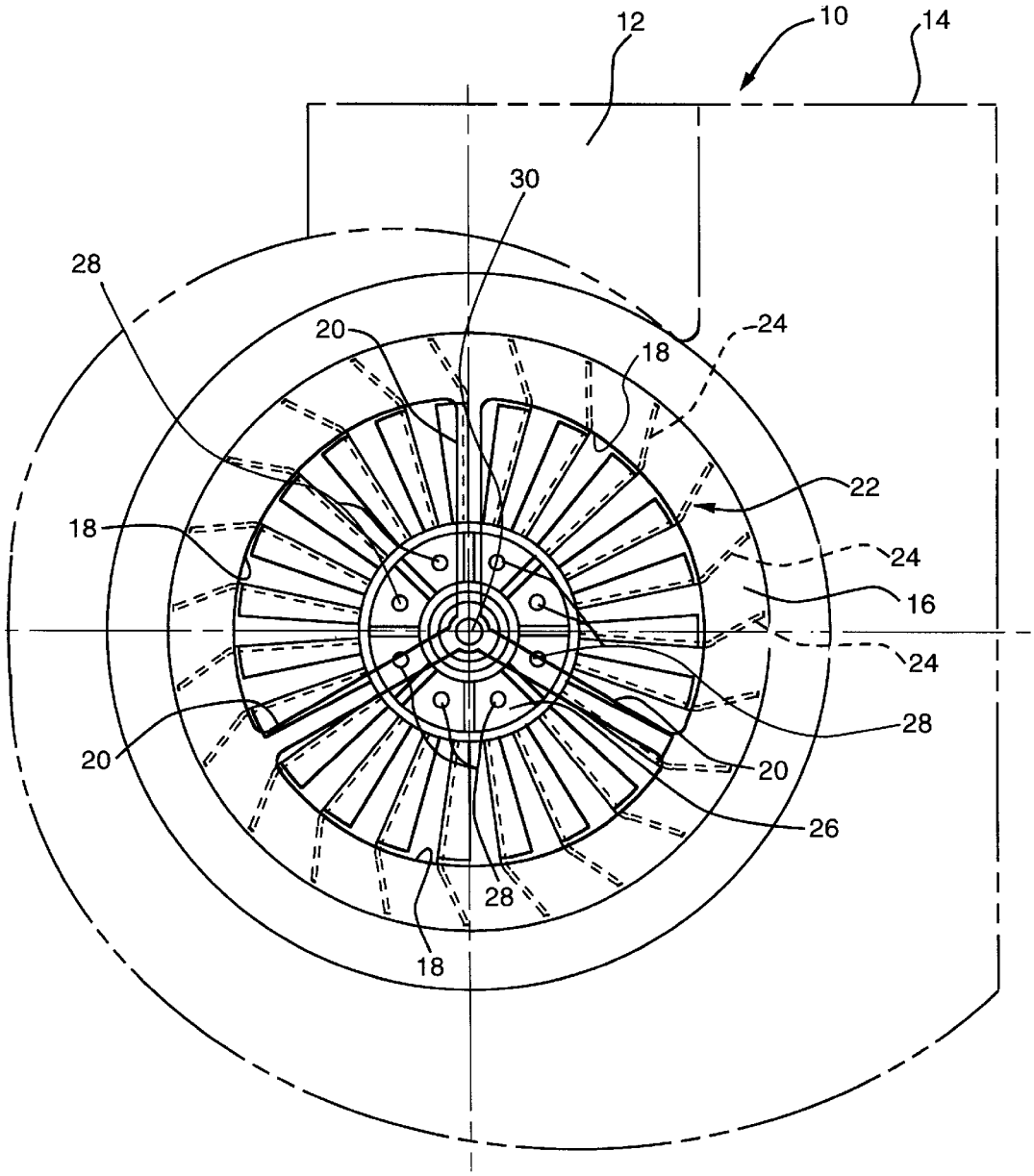
FIG. 1 is an elevated perspective view of a blower unit in accordance with one embodiment of the present invention.

FIG. 1 is an elevated perspective view of a blower unit 10 in accordance with one embodiment of the present invention. Blower unit 10 includes a blower housing 12 having an air flow outlet 14. Housing 12 also includes a rotor cover 16 having cutouts 18 and support ribs 20.

A fan support subassembly 22 is positioned within blower housing 12, and fan support subassembly 22 includes a plurality of vanes 24 extending from an air baffle and bearing support 26. Air flow openings 28 are formed in support 26 to further facilitate air flow into housing 12. As described hereinafter in more detail, fan support subassembly 22 is mounted to, and supported by, an elongate main mounting member 30. Fan support subassembly 22 is rotatable relative to mounting member 30 and housing 12.

FIG. 2 is an elevated perspective view of a portion of one vane 24 shown in FIG. 1. Vane 24 is illustrated by way of example only, and vanes 24 may have many different configurations. Vane 24, as shown in FIG. 2, includes an inducer portion 32 which, when rotating, draws air into blower unit 10. Such inducer portion 32 is believed to enhance the efficiency of blower unit 10.

FIG. 3 is a cross section, with some parts cut-away, of blower unit 10 shown in FIG. 1. As shown in FIG. 3, main mounting member 30 is elongate and extends at least partially across the width of housing 12. A stator 34 including a stator core 36 and stator windings 38 is secured to main mounting member 30. Stator 34 may, for example, include an opening 39 through which main mounting member 30 extends and is secured to mounting member 30 using an epoxy. Stator core 36, in one embodiment and as is well known, is formed from a plurality of stacked iron lamination, and windings 38 are pressed into slots formed in stator core 36.

Fan subassembly 22, including a rotor 40, also is mounted to main mounting member 30. Fan subassembly 22, however, is rotatable relative to main mounting member 30. More specifically, rotor 40 includes a first magnetic portion 42 having a substantially cylindrical shape and defining the outer periphery of a rotor bore 44. Rotor 40 further includes a substantially cylindrical iron ring 46. Rotor first magnetic portion 42 is secured within an inner diameter of iron ring 46. Rotor first magnetic portion 42, in one embodiment, is formed from neodymium-iron-boron permanent magnet material. Iron ring 46, in one embodiment, is formed from powdered iron fused in a polymer matrix. Stator 34 is located in rotor bore 44 and is concentric with respect to rotor 40.

For ease of assembly, and in one embodiment, fan subassembly 22 includes first and second fan subassembly units 46A and 46B. First and second fan subassembly units 46A and 46B each include a plurality of vanes 24. Rotor first magnetic portion 42 and iron ring 46 are mounted in first fan subassembly unit 46A. Second fan subassembly unit 46B includes a cutout portion 48 for receiving rotor first magnetic portion 42 and iron ring 46 when assembled to first fan subassembly unit 46A.

In addition, first fan subassembly unit 46A includes first bosses 50 and second fan subassembly unit 46B includes second bosses 52. First bosses 50 and second bosses 52 are configured to form an interference fit therebetween to securely maintain first and second fan subassembly units 46A and 46B in engagement.

First and second fan subassembly units 46A and 46B, as described above, include vanes 24. In the embodiment shown in FIG. 3, each vane 24 includes an axial flow inducer portion 32 and a radial flow impeller portion 54. Vanes 24 could, of course, have many other configurations. For example, vanes 24 could have only radial flow impeller portions as described hereinafter in more detail.

Rotor 40 is coupled to vanes 24 so that vanes 24 rotate with rotor 40. More specifically, first and second fan subassembly units 46A and 46B include rotor support members 56 which extend between vanes 24 and support rotor 40.

Fan subassembly unit 22 is supported on main mounting member 30 by bearing assemblies 58. More specifically, bearing assemblies 58 are engages at ends 60 of air baffle and bearing supports 26. In the embodiment shown in FIG. 3, bearing assemblies 58 are spring biased towards, and in rotatable engagement with, main mounting member 30. Bearing assemblies 58 may be ball bearings, as shown in FIG. 3, or alternatively, rotatable support apparatus such as sleeve bearings.

Fan subassemblies 22 further includes shrouds 62 supported by main mounting member 30 on support ribs 64. Support ribs 64 are engaged to rings 66 which are secured to main mounting member 30. Shrouds 62 facilitate directing air flow towards vanes 24 and into blower housing 12. Shrouds 62 may be molded integrally as part of first and second fan subassembly units 46A and 46B.

Air baffle and bearing supports 26, vanes 24, and shrouds 62 of fan subassembly 22 described above are molded from a plastic such as a thermoplastic or a thermoset. Use of thermoplastic for such components is believed to reduce the cost of unit 10 as compared to the cost of known blower units. Further, in the one embodiment described above, integrating rotor 40, vanes 24, and shrouds 62 into fan subassembly 22 is believed to greatly simplify both the manufacture and assembly of blower unit 10. As a result, blower unit 10 is believed to be less expensive to manufacture and assemble than known blower units.

Blower unit 10 also includes electronic control unit 68 and other motor control components such as capacitors 70 secured to mounting ring 72. Mounting ring 72 is secured to mounting member 30. Control unit 68 is electrically connected to stator windings 38 and controls energization of windings 38, as is well known.

More specifically, in operation, control unit 68 enables energy to be supplied to windings 38. A rotating material field is generated by windings 38, and such rotating field couples with the field of rotor magnetic portions 42. When such coupling occurs, rotor 40 begins to rotate, and since rotor 40 is integral with fan subassembly 22, subassembly 22 rotates under the control of the rotating magnetic field. As subassembly 22 rotates, air is drawn into housing 12 by vanes 24, and specifically, by inducer portions 32 of vanes 24. Such air is then forced through housing 12 and out air flow outlet 14 primarily by the action of impeller portions 54 of vanes 24.

Fan subassembly 22 is believed to greatly simplify both the manufacture and assembly of blower unit 10. Blower unit 10 therefore is believed to be less expensive to manufacture and assemble than known blower units. In addition, by using an efficient motor such as an electronically commutated motor (ECM), blower unit 10 is believed to be more efficient than known blower units. Therefore, cost savings can be achieved by blower unit 10 at the same time that blower efficiency is increased.

Figure 4:
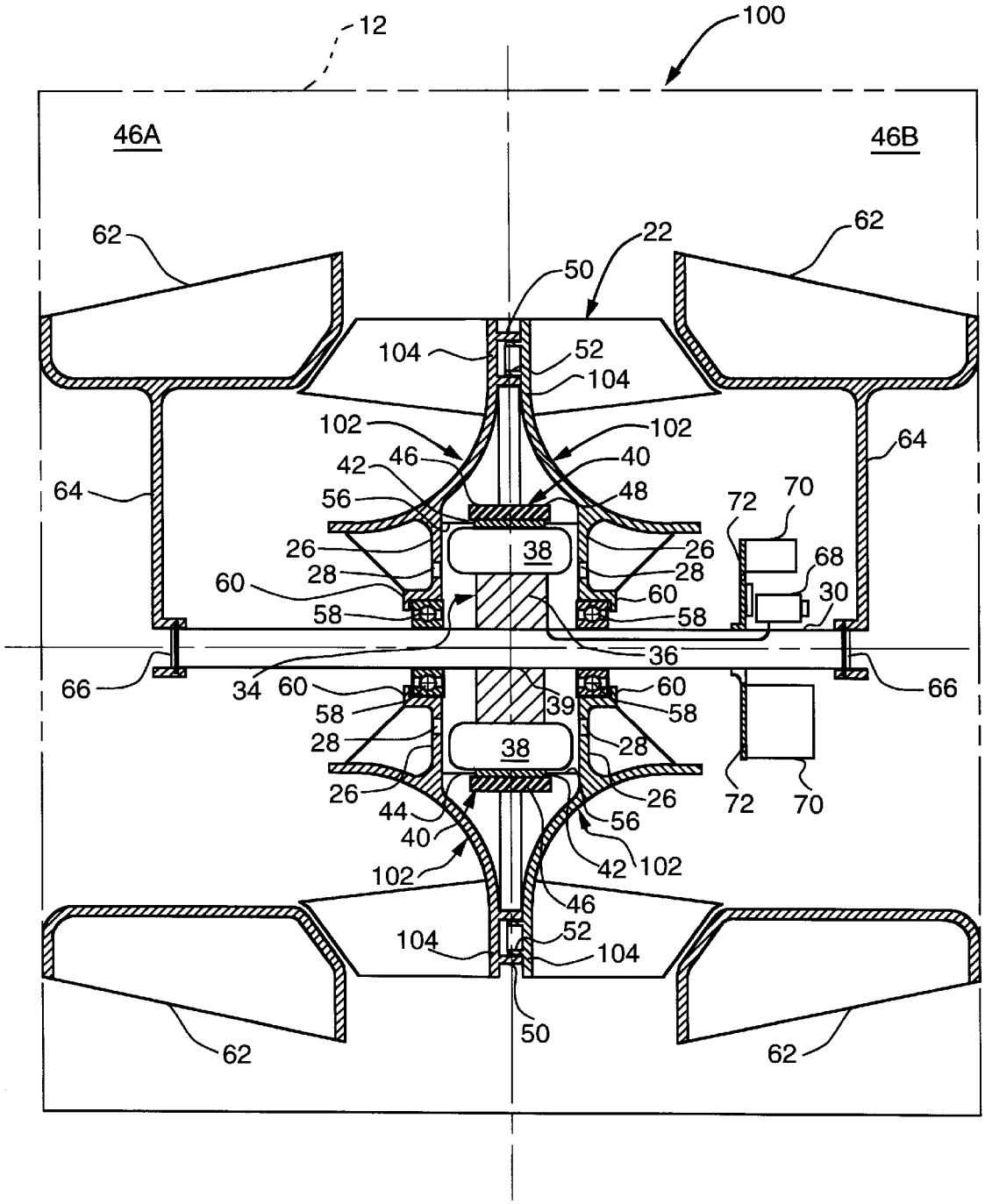
FIG. 4 is a cross section, with parts cut-away, of another embodiment of a blower unit in accordance with the present invention.

FIG. 4 is a cross section, with parts cut-away, of another embodiment of a blower unit 100 in accordance with the present invention. Blower unit 100 includes many of the same components as blower unit 10, and components of blower unit 100 which are the same as components of blower unit 10 are indicated on FIG. 4 using the same reference numerals as used in connection with describing blower unit 10. A difference between blower unit 10 and blower unit 100 is that in blower unit 100, vanes 102 include only a radial flow impeller portion 104. In blower unit 10, vanes 24 include both inducer portion 32 and radial flow impeller portion 54. Of course, there are many other possible configurations for the blower unit vanes, and vanes 24 and 102 are illustrated herein by way of example only. As compared to vane 24, vane 102 is believed to be less expensive to fabricate but may be less efficient in operation than vane 24.

Another difference between blower unit 100 and blower unit 10 is that in blower unit 100, control unit 68 and capacitors 70 are mounted on mounting ring 72 within a space defined by, and between, support ribs 64. In unit 10, and as shown in FIG. 3, such components are mounted on an opposite side of ribs 64. By mounting such components between ribs 64, blower unit 100 is more compact than unit 10.

The blower units described above are easy to assemble and low in cost as compared to known blower units. In addition, by using an efficient motor such as an electronically commutated motor (ECM), the above described blower units are believed to be at least as efficient as known blower units. Therefore, the cost savings realized by the above described blower unit constructions do not adversely affect blower efficiency.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A blower unit, comprising:

an elongate main mounting member;

a stator comprising a stator core and stator windings, said stator being secured to said main mounting member; and a fan subassembly comprising first and second integral fan subassembly units, the first integral fan subassembly unit including a first boss, a rotor and a plurality of vanes, said rotor having a rotor bore, said stator being located in said rotor bore and concentric with respect to said rotor, said rotor being coupled to said plurality of vanes of said first integral fan subassembly so that said vanes of said first integral fan subassembly rotate with said rotor, said second integral fan subassembly unit comprising a second boss and a plurality of vanes and having a cutout portion for receiving said rotor, said rotor being coupled to said plurality of vanes of said second integral fan subassembly so that said vanes of said second integral fan subassembly rotate with said rotor, said first and second bosses configured to securely maintain said first and second integral fan subassembly units in alignment.

2. A blower unit in accordance with claim 1 wherein said fan assembly further comprises at least one bearing assembly, said bearing assembly being spring biased towards and into rotatable engagement with said elongate main mounting member.

3. A blower unit in accordance with claim 2 wherein said bearing assembly comprises at least one ball bearing.

4. A blower unit in accordance with claim 2 wherein said bearing assembly comprises at least one sleeve bearing.

5. A blower unit in accordance with claim 1 wherein each of said vanes comprises an axial flow inducer portion and a radial flow impeller portion.

6. A blower unit in accordance with claim 1 wherein said fan subassembly comprises a shroud for partially enclosing said plurality of vanes.

7. A blower unit in accordance with claim 1 wherein said rotor further comprises a first magnetic portion having a substantially cylindrical shape and a substantially cylindrical iron ring, said first magnetic portion being secured within an inner diameter of said iron ring.

8. A blower unit in accordance with claim 7 wherein said first magnetic portion is formed from neodymium-iron-boron permanent magnet material.

9. A blower unit in accordance with claim 7 wherein said iron ring is formed from powdered iron fused in a polymer matrix.

10. A blower unit, comprising:

an elongate main mounting member;

a stator comprising a stator core and stator windings, said stator being secured to said main mounting member; and a fan assembly comprising first and second integral fan subassembly units, the first integral fan subassembly unit including a rotor and a plurality of vanes, said rotor comprising a substantially cylindrical iron ring, a magnetic portion having a substantially cylindrical shape, said magnetic portion being secured within an inner diameter of said iron ring and defining a rotor bore, said stator being located in said rotor bore and concentric with respect to said rotor, said rotor being coupled to said plurality of vanes of said first integral fan subassembly so that said vanes of said first integral fan subassembly rotate with said rotor, said second integral fan subassembly unit comprising a plurality of vanes and having a cutout portion for receiving said rotor, said rotor being coupled to said plurality of vanes so that said vanes of said second integral fan subassembly rotate with said rotor, and a shroud for partially enclosing said plurality of vanes of the first and second integral fan subassembly units.

11. A blower unit in accordance with claim 10 wherein said fan assembly further comprises at least one bearing assembly, said bearing assembly being spring biased towards and into rotatable engagement with said elongate main mounting member.

12. A blower unit in accordance with claim 10 wherein each of said vanes comprises an axial flow inducer portion and a radial flow impeller portion.

* * * * *